US010428779B2

(12) United States Patent
Kleindl et al.

(10) Patent No.: US 10,428,779 B2
(45) Date of Patent: Oct. 1, 2019

(54) FUEL INJECTOR

(71) Applicant: Robert Bosch GmbH, Stuttgart (DE)

(72) Inventors: Michael Kleindl, Schwieberdingen (DE); Cornelia Giessler, Beilstein (DE)

(73) Assignee: Robert Bosch GmbH, Stuttgart (DE)

( * ) Notice: Subject to any disclaimer, the term of this patent is extended or adjusted under 35 U.S.C. 154(b) by 476 days.

(21) Appl. No.: 13/765,342

(22) Filed: Feb. 12, 2013

(65) Prior Publication Data

US 2013/0206872 A1 Aug. 15, 2013

(30) Foreign Application Priority Data

Feb. 15, 2012 (DE) ..... 10 2012 202 253

(51) Int. Cl.
*F02M 51/06* (2006.01)

(52) U.S. Cl.
CPC .... *F02M 51/0625* (2013.01); *F02M 51/0685* (2013.01); *F02M 2200/02* (2013.01)

(58) Field of Classification Search
CPC ..... F02M 51/00; F02M 51/0671; F02M 51/0685; F02M 51/0682; F02M 63/0075; F02M 61/166; F02M 51/06; F02M 51/0625; B05B 1/30; B21J 15/50; B23B 2265/32; B23B 47/284
USPC ..... 239/585.1, 585.3, 585.4, 585.5, 584.3, 239/584.4, 533.2, 586, 581.1
See application file for complete search history.

(56) References Cited

U.S. PATENT DOCUMENTS

| | | | | |
|---|---|---|---|---|
| 4,311,280 | A * | 1/1982 | Knape | 239/585.2 |
| 4,586,656 | A * | 5/1986 | Wich | 239/88 |
| 6,056,024 | A * | 5/2000 | Noah et al. | 141/21 |
| 6,056,264 | A * | 5/2000 | Benson | F02M 47/027 251/129.15 |
| 6,170,767 | B1 * | 1/2001 | Herold | F02M 51/0685 239/585.1 |
| 6,796,543 | B2 * | 9/2004 | Haeberer | F02M 47/027 239/585.3 |
| 6,869,034 | B2 * | 3/2005 | Glaser | 239/585.5 |
| 6,892,971 | B2 * | 5/2005 | Rieger | F02M 51/0617 239/585.1 |
| 6,932,283 | B2 * | 8/2005 | Stier | 239/585.1 |
| 7,086,614 | B2 * | 8/2006 | Stier et al. | 239/585.2 |

(Continued)

FOREIGN PATENT DOCUMENTS

| | | |
|---|---|---|
| DE | 101 30 205 | 1/2003 |
| DE | 10 2010 062 420 | 6/2011 |

(Continued)

*Primary Examiner* — Arthur O. Hall
*Assistant Examiner* — Christopher R Dandridge
(74) *Attorney, Agent, or Firm* — Norton Rose Fulbright US LLP; Gerard Messina

(57) ABSTRACT

A fuel injector for direct injection of fuel into a combustion chamber includes: a housing having at least one combustion chamber-side injection aperture; a linearly movable valve needle for opening and closing the injection aperture; a solenoid; an armature which is linearly movable by the solenoid; and a first sleeve attached to the armature. A first stop surface facing away from the combustion chamber is formed on the first sleeve, and a second stop surface facing the combustion chamber is formed on the valve needle, the first and second stop surfaces striking one another when the valve needle and/or the armature is/are moved linearly.

10 Claims, 3 Drawing Sheets

(56) References Cited

U.S. PATENT DOCUMENTS

| | | | | |
|---|---|---|---|---|
| 8,528,842 | B2 * | 9/2013 | Hoang | 239/585.1 |
| 8,960,156 | B2 * | 2/2015 | Martinsson | B21D 53/84<br>123/470 |
| 2004/0050977 | A1 * | 3/2004 | Rieger | F02M 51/0685<br>239/585.1 |
| 2007/0007363 | A1 * | 1/2007 | Mifuji | F02M 51/0607<br>239/102.2 |
| 2009/0288640 | A1 * | 11/2009 | Shingu | F02M 51/0671<br>123/472 |
| 2012/0080542 | A1 * | 4/2012 | Imai | F02M 51/0671<br>239/533.2 |
| 2012/0204839 | A1 * | 8/2012 | Ohwada | F02M 51/0614<br>123/472 |

FOREIGN PATENT DOCUMENTS

| | | |
|---|---|---|
| WO | WO 02/053906 | 7/2002 |
| WO | WO 02/095215 | 11/2002 |

* cited by examiner

FUEL INJECTOR

BACKGROUND OF THE INVENTION

1. Field of the Invention

The present invention relates to a fuel injector for injecting fuel directly into a combustion chamber.

2. Description of the Related

Various valves for direct fuel injection are known from the related art. In this connection, a valve needle is normally moved against a closing spring with the aid of an actuator in such a way that a desired quantity of fuel is specifically introduced into the combustion chamber. In the case of rapidly closing fuel injectors, high dynamics occur, including the forces resulting from them. In connection with the soft magnetic materials in the armature and the internal pole, these forces result in high wear. During operation, this wear causes the valve to deviate from the specification. In the related art, it is sometimes proposed to move the armature against a stop plate. However, these stop plates involve a relatively large space requirement and increase the weight and accordingly the rebound tendency of the valve. Furthermore, these increased masses result in heightened wear on the components of the valve.

BRIEF SUMMARY OF THE INVENTION

The fuel injector according to the present invention makes it possible to reduce the wear on the armature and/or the valve needle. This extends the service life of the fuel injector. The sleeves used have only a very low volume and accordingly a low mass. The reduction in mass decreases the shock when the fuel injector is closed, which also reduces the tendency to rebound. The large number of closing and opening operations results in wear between the valve needle and valve seat over the service life. This wear is also reduced by the low masses.

All of these advantages are achieved by a fuel injector, in particular for direct injection of fuel into a combustion chamber, including a housing having at least one combustion chamber-side injection aperture. The fuel is introduced from the fuel injector into the combustion chamber via this at least one injection aperture. Furthermore, the fuel injector includes a linearly movable valve needle, a solenoid and an armature which is linearly movable by the solenoid. The linearly movable valve needle is used for opening and closing the at least one injection aperture. In particular, the valve needle includes a base body extending along the longitudinal axis of the fuel injector. A first sleeve is attached to the armature. This first sleeve is manufactured separately from the armature and is fixedly attached to the armature. A first stop surface facing the combustion chamber is formed on the first sleeve. A second stop surface facing away from the combustion chamber is formed on the valve needle. The first stop surface and the second stop surface are situated in such a way that they strike one another when the valve needle and/or the armature is/are moved linearly. The two stop surfaces are thus diametrically opposed; in particular, the two stop surfaces are formed as annular surfaces. If the armature is moved with the aid of the solenoid in the direction of opening and thus to the side of the fuel injector facing away from the combustion chamber, the first stop surface strikes the second stop surface and the armature takes the valve needle along in the direction of opening.

It is preferably provided that the armature has a continuous recess and the sleeve is situated on the wall of the recess. Furthermore, the valve needle preferably extends through this recess. In particular, this recess is formed as a round through hole which is coaxial to the longitudinal axis of the fuel injector.

It is furthermore advantageously provided that the recess has a uniform diameter over its entire length, measured parallel to the longitudinal axis. This makes it possible to attach a simply designed sleeve to the wall of the recess.

It is furthermore preferably provided that a groove is formed in the wall of the recess. This groove is in particular designed to be fully circumferential. The first sleeve is situated in this groove. With the aid of this groove, in particular, the sleeve and the armature are form-locked.

The first sleeve is in particular designed in such a way that it protrudes beyond the wall of the recess. In particular, this protruding portion of the first sleeve forms the first stop surface.

It is furthermore preferably provided that the groove is open on the side of the armature facing away from the combustion chamber. This ensures that the entire side of the first sleeve facing away from the combustion chamber may be used as a first stop surface. Furthermore, the laterally open groove makes it simple to mount the first sleeve in the armature.

In a first variant, the second stop surface may be formed directly on the base body of the valve needle. Alternatively, it is preferably provided to attach a second sleeve on the base body of the valve needle. The second stop surface is formed on this second sleeve. In particular, the second sleeve is situated on an end of the base body of the valve needle facing away from the combustion chamber.

The first sleeve and/or the second sleeve is/are preferably made from a hard material or is/are coated to form a hardened surface. In particular, it is preferably provided that the first sleeve is made from a more solid material than the armature, and/or the second sleeve is made from a more solid material than the remaining components, in particular the base body of the valve needle.

The first sleeve and/or the second sleeve is/are preferably attached to the armature or to the base body of the valve needle in a form-locked manner and/or in a friction-fit manner and/or in an integrally joined manner.

The valve needle may be designed as a hollow needle or as a solid needle.

DETAILED DESCRIPTION OF THE INVENTION

Figure 1:
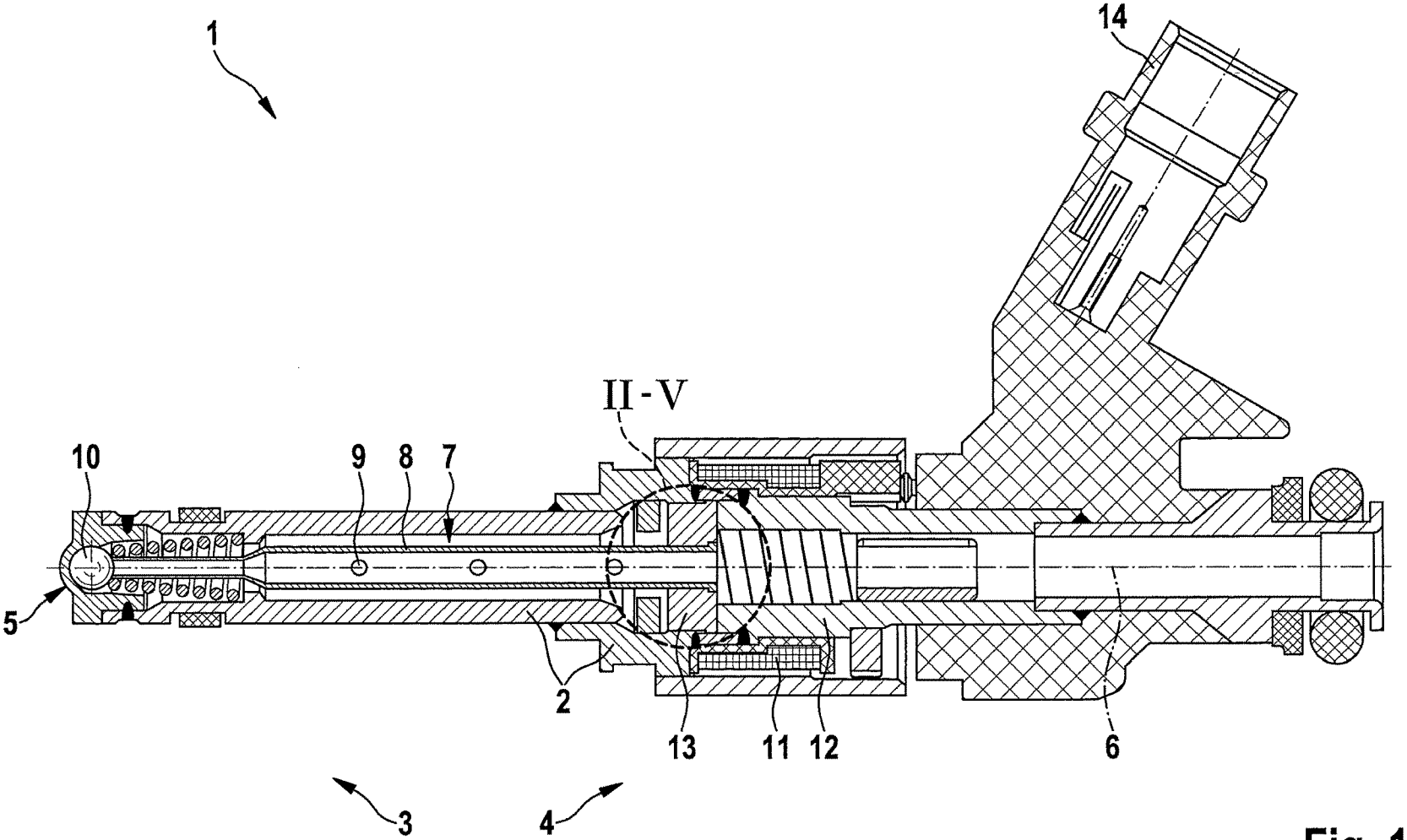
FIG. 1 shows a fuel injector according to the present invention according to a first through a fourth exemplary embodiment.

Referring to FIG. 1, the basic structure of fuel injector 1 will be explained for the four exemplary embodiments described below.

FIG. 1 shows fuel injector 1 in a section parallel to longitudinal axis 6. Fuel injector 1 includes a housing 2, which on a side 3 facing the combustion chamber includes at least one injection aperture 5. Via this injection aperture 5, fuel is injected into a combustion chamber. A side 4 facing away from the combustion chamber is diametrically opposed to side 3 facing the combustion chamber In housing 2, a valve needle 7 is guided coaxially to longitudinal axis 6 in a linearly movable manner. This valve needle 7 has a base body 8. This base body 8 is internally hollow and has apertures 9. With the aid of valve needle 7, a spherical closing body 10 is pressed onto injection aperture 5. For opening the fuel injector, valve needle 7 is moved in the direction of side 4 facing away from the combustion chamber. Closing body 10 then lifts off from injection aperture 5, making it possible for fuel to be injected.

Furthermore, a solenoid 11 and an annular internal pole 12 are situated in housing 2. An armature 13 is attached to base body 8 of valve needle 7. Internal pole 12 is magnetized via solenoid 11 and thus moves armature 13 linearly to longitudinal axis 6. Moreover, a plug connector 14 of the fuel injector is represented in FIG. 1.

Four exemplary embodiments of fuel injector 1 are shown based on FIGS. 2 through 5. FIGS. 2 through 5 each show the detail from FIG. 1 labeled II-V. Identical or functionally identical components are provided with the same reference numerals in all exemplary embodiments.

Figure 2:
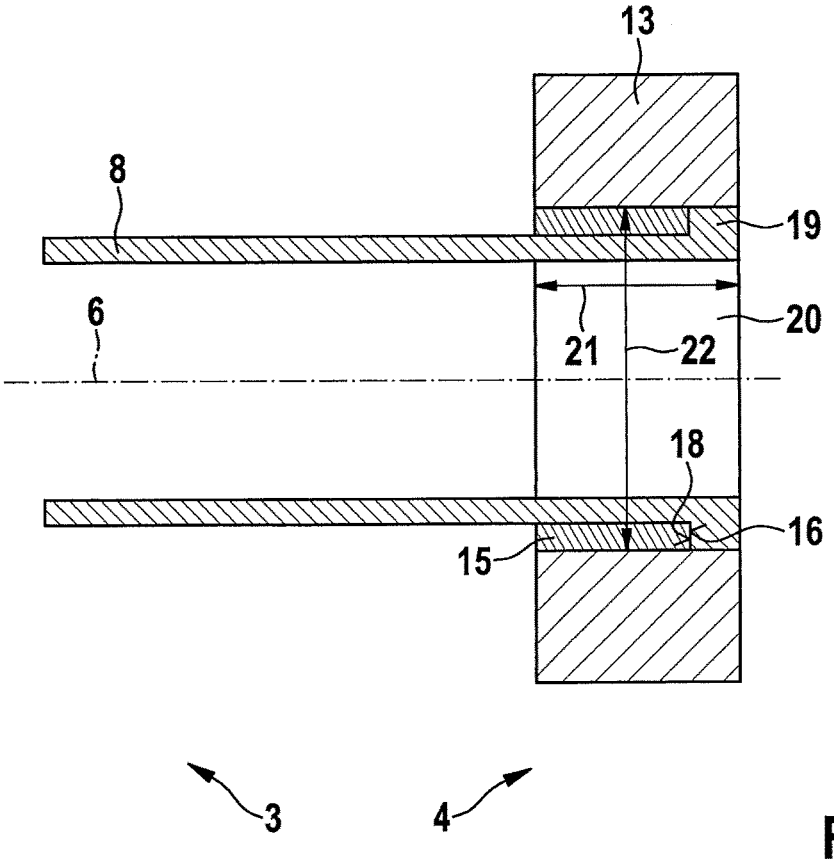
FIG. 2 shows a detail of the fuel injector according to the present invention according to the first exemplary embodiment.

FIG. 2 shows a detail of fuel injector 1 according to the first exemplary embodiment. Armature 13 is shown having an inner, continuous recess 20. A first sleeve 15 is attached to the wall of recess 20. This first sleeve 15 is fixedly connected to armature 13. Furthermore, valve needle 7 is situated within recess 20. A thickening 19 is formed on the end of base body 8 of valve needle 7 facing away from the combustion chamber.

On its side facing away from the combustion chamber, first sleeve 15 has a first stop surface 16. A second stop surface 18 facing the combustion chamber is formed on thickening 19. In the case of a movement of armature 13 and/or of valve needle 7, the two stop surfaces 16, 18 strike one another. First sleeve 15 is manufactured from a harder material than armature 13. This largely avoids wear on first stop surface 16.

Furthermore, FIG. 2 shows a length 21 of recess 20, measured parallel to longitudinal axis 6, and a diameter 22 of recess 20. The external diameter of first sleeve 15 corresponds to diameter 22 of recess 20. The length of first sleeve 15 is shorter than length 21 of recess 20. A total length of first sleeve 15 and thickening 19, measured parallel to longitudinal axis 6, corresponds to length 21 of recess 20.

Figure 3:
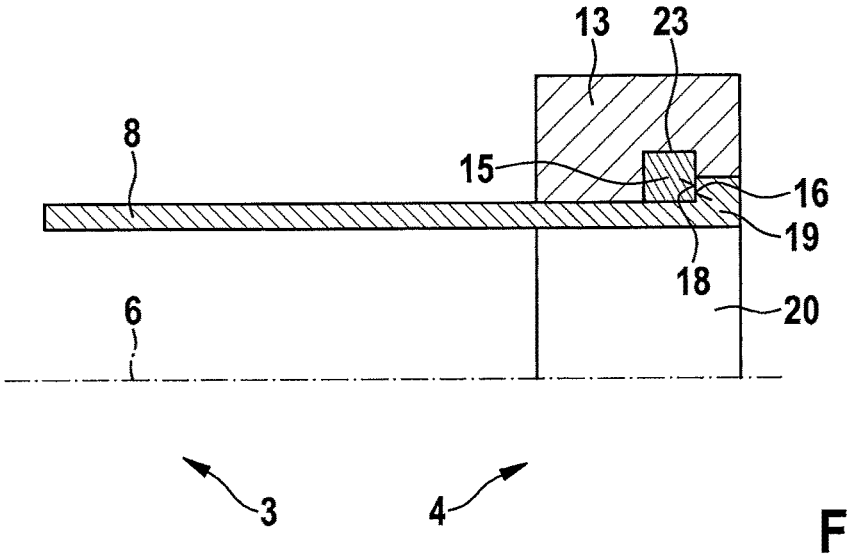
FIG. 3 shows a detail of the fuel injector according to the present invention according to the second exemplary embodiment.

FIG. 3 shows a detail of fuel injector 1 according to the second exemplary embodiment. In the second exemplary embodiment, armature 13 has a circumferential groove 23. First sleeve 15 is inserted into this circumferential groove 23. In this connection, first sleeve 15 has in particular a square cross-section. The diameter of recess 20 on the combustion chamber side of groove 23 is smaller than the diameter of recess 20 on the side of groove 23 facing away from the combustion chamber. As a result, first sleeve 15 protrudes beyond the wall of recess 20 and at least one portion of first sleeve 15 may be used as first stop surface 16.

Figure 4:
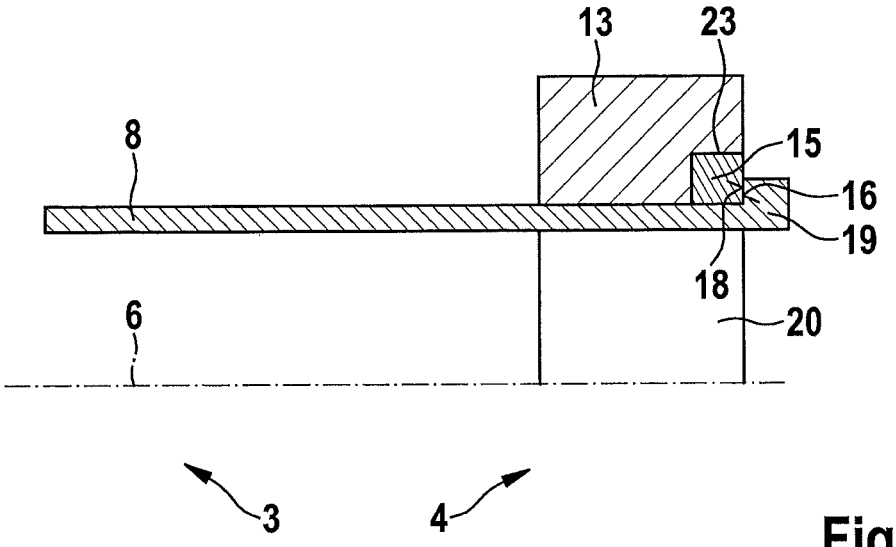
FIG. 4 shows a detail of the fuel injector according to the present invention according to the third exemplary embodiment.

FIG. 4 shows a detail of fuel injector 1 according to the third exemplary embodiment. In this case, groove 23 is formed on an end of armature 13 facing away from the combustion chamber. As a result, groove 23 is open both to side 4 facing away from the combustion chamber and to longitudinal axis 6. This groove 23 makes it possible to mount first sleeve 15 relatively simply and simultaneously makes it possible for the entire side of first sleeve 15 facing away from the combustion chamber to be available as first stop surface 16.

Figure 5:
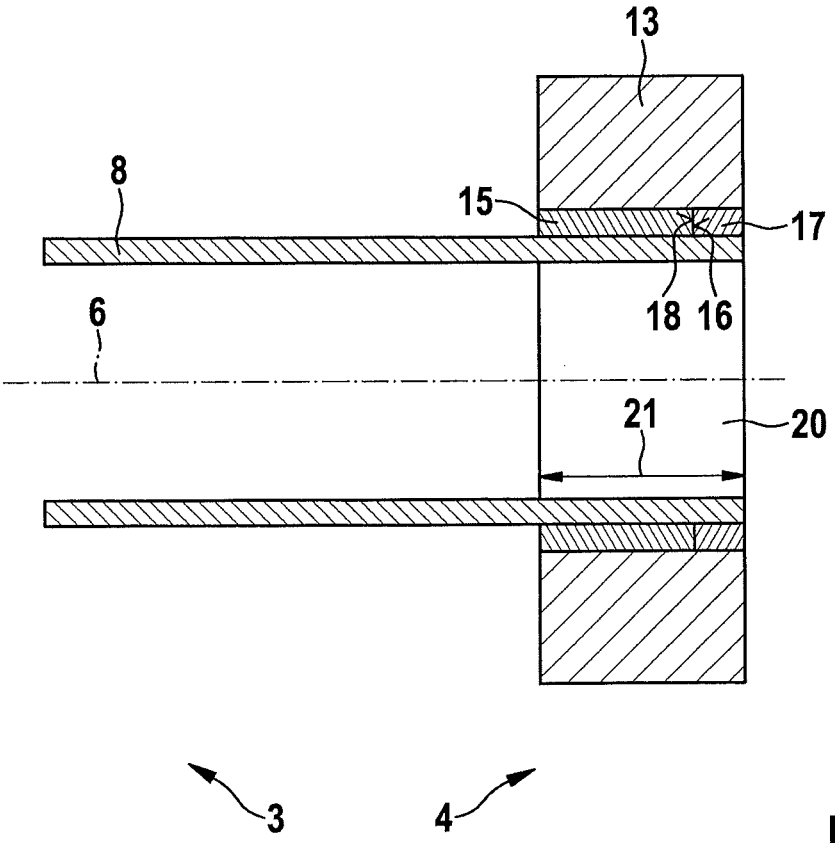
FIG. 5 shows a detail of the fuel injector according to the present invention according to the fourth exemplary embodiment.

FIG. 5 shows a detail of fuel injector 1 according to the fourth exemplary embodiment. First sleeve 15 and armature 13 are formed just as in the first exemplary embodiment. Instead of thickening 19 on base body 8 of valve needle 7, a second sleeve 17 is in this case fixedly connected to base body 8 of valve needle 7. This second sleeve 17 is preferably made from a hardened material or includes a hardened surface, so that the wear on second stop surface 18 is also reduced. As shown in FIG. 5, a total length of first sleeve 15 and second sleeve 17, measured parallel to longitudinal axis 6, has the same value as length 21 of recess 20.

What is claimed is:

1. A fuel injector for direct injection of fuel into a combustion chamber, comprising:

a housing having at least one combustion-chamber side injection aperture;

a linearly movable valve needle for opening and closing the injection aperture;

a solenoid;

an armature which is linearly movable by the solenoid; and a first sleeve, the first sleeve being formed as a hollow, tubular component having a constant inside and outside diameter;

wherein the first sleeve is a separate component and the first sleeve is attached to the armature;

wherein a first stop surface facing away from the combustion chamber is formed on the first sleeve, and a second stop surface facing the combustion chamber is formed on the valve needle, the first and second stop surfaces striking one another when at least one of the valve needle and the armature is moved linearly; and wherein the armature has a continuous recess and the first sleeve is situated on a wall of the recess;

wherein a groove is formed in the wall of the recess, and wherein the first sleeve is situated in the groove and further comprising a second sleeve attached to a base body of the valve needle, wherein the second stop surface is formed on the second sleeve;

wherein a total length of the first sleeve and the second sleeve, measured parallel to a longitudinal axis of the fuel injector, has a same value as a length of the recess.

2. The fuel injector as recited in claim 1, wherein the recess has a uniform diameter over the entire length of the recess.

3. The fuel injector as recited in claim 1, wherein the first sleeve protrudes beyond the wall of the recess.

4. The fuel injector as recited in claim 1, wherein the groove is open on a side of the armature facing away from the combustion chamber.

5. The fuel injector as recited in claim 1, wherein at least one of:

the first sleeve is made from a more solid material than the armature; and the second sleeve is made from a more solid material than the remaining components of the valve needle.

6. The fuel injector as recited in claim 1, wherein at least one of:

the first sleeve is attached to the armature in at least one of a form-locked manner, a friction-fit manner, and an integrally joined manner; and the second sleeve is attached to the valve needle in at least one of a form-locked manner, a friction-fit manner, and an integrally joined manner.

7. The fuel injector as recited in claim 1, wherein the first sleeve and the wall of a recess are in contact along the linear axis of the fuel injector.

8. A fuel injector for direct injection of fuel into a combustion chamber, comprising:

a housing having at least one combustion-chamber side injection aperture;

a linearly movable valve needle for opening and closing the injection aperture; a solenoid;

an armature which is linearly movable by the solenoid; and a first sleeve, the first sleeve is formed as a hollow, tubular component having a constant inside and outside diameter;

wherein the first sleeve is a separate component and the first sleeve is attached to the armature;

wherein a first stop surface facing away from the combustion chamber is formed on the first sleeve, and a second stop surface facing the combustion chamber is formed on the valve needle, the first and second stop surfaces striking one another when at least one of the valve needle and the armature is moved linearly; and wherein the armature has a continuous recess and the first sleeve is situated on a wall of the recess, wherein the first sleeve is a harder material than the armature;

wherein a groove is formed in the wall of the recess, and wherein the first sleeve is situated in the groove and further comprising a second sleeve attached to a base body of the valve needle, wherein the second stop surface is formed on the second sleeve;

wherein a total length of the first sleeve and the second sleeve, measured parallel to a longitudinal axis of the fuel injector, has a same value as a length of the recess.

9. The fuel injector as recited in claim 1, wherein the first sleeve is situated in the recess of the armature, wherein the first stop surface of the first sleeve and the second stop surface of the valve needle lie in an interior of the recess.

10. The fuel injector for direct injection of fuel into a combustion chamber as recited in claim 8, wherein the first sleeve is situated in the recess of the armature, wherein the first stop surface of the first sleeve and the second stop surface of the valve needle lie in an interior of the recess.

* * * * *